US010047711B2

(12) United States Patent
Serra et al.

(10) Patent No.: US 10,047,711 B2
(45) Date of Patent: Aug. 14, 2018

(54) FUEL INJECTION ASSEMBLY FOR A COMBUSTION ENGINE

(71) Applicant: Continental Automotive GmbH, Hannover (DE)

(72) Inventors: Giandomenico Serra, San Giuliano Terme (IT); Daniel Marc, Leghorn (IT)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 329 days.

(21) Appl. No.: 14/293,132

(22) Filed: Jun. 2, 2014

(65) Prior Publication Data

US 2015/0013643 A1 Jan. 15, 2015

(30) Foreign Application Priority Data

Jul. 10, 2013 (EP) ..... 13175850

(51) Int. Cl.
*F02M 61/14* (2006.01)
*F02M 61/16* (2006.01)

(52) U.S. Cl.
CPC ..... *F02M 61/14* (2013.01); *F02M 61/168* (2013.01); *F02M 2200/85* (2013.01); *F02M 2200/853* (2013.01); *F02M 2200/856* (2013.01)

(58) Field of Classification Search
USPC ..... 123/470
See application file for complete search history.

(56) References Cited

U.S. PATENT DOCUMENTS 5,803,052 A 9/1998 Lorraine et al. ..... 123/470
5,970,953 A * 10/1999 Lorraine ..... F02M 61/14 123/456

(Continued)

FOREIGN PATENT DOCUMENTS

CN 102046958 A 5/2011 ..... F02M 55/00
DE 69817266 T2 8/2004 ..... F02M 61/14

(Continued)

OTHER PUBLICATIONS

European Search Report and Written Opinion, Application No. 13175850, 5 pages, dated Nov. 15, 2013.

(Continued)

*Primary Examiner* — Lindsay Low
*Assistant Examiner* — Ruben Picon-Feliciano
(74) *Attorney, Agent, or Firm* — Slayden Grubert Beard PLLC

(57) ABSTRACT

A fuel injection assembly for a combustion engine includes an injector body, an injector cupradially enclosing an axial end of the injector body, and a spring clip coupling the injector cup with the injector body. The spring clip includes a ground plate with a main extension plane perpendicular to a longitudinal axis of the fuel injection assembly, a recess extending inwards from a lateral end of the ground plate to a bottom part having a circle-segment contour extending through an angle between 270° to 180°, and at least one spring element fixed to the ground plate. The spring element of the spring clip has a contact region with the injector cup, and the ground plate has a contact region with the injector body, whereby the spring element exerts a spring force on the injector cup. The ground plate of the spring clip extends into a cutout of the injector cup.

15 Claims, 4 Drawing Sheets

(56) References Cited

U.S. PATENT DOCUMENTS

| | | | | |
|---|---|---|---|---|
| 7,556,022 | B1 * | 7/2009 | Doherty | F02M 55/004 123/456 |
| 7,765,984 | B2 | 8/2010 | Fuerst et al. | 123/456 |
| 7,802,559 | B2 * | 9/2010 | Furst | F02M 61/14 123/470 |
| 7,938,455 | B2 * | 5/2011 | Rapp | F02M 55/002 285/305 |
| 8,707,930 | B2 | 4/2014 | Bolz et al. | 123/470 |
| 2006/0137659 | A1 * | 6/2006 | Zdroik | F02M 55/005 123/470 |
| 2009/0235899 | A1 * | 9/2009 | Biasci | F02M 55/005 123/470 |
| 2011/0017175 | A1 | 1/2011 | Grandi | 123/470 |
| 2013/0192565 | A1 * | 8/2013 | Roseborsky | F02M 61/14 123/470 |

FOREIGN PATENT DOCUMENTS

| | | | | |
|---|---|---|---|---|
| EP | 1892408 | A1 | 2/2008 | F02M 55/00 |
| EP | 2187040 | A2 | 5/2010 | F02M 55/00 |
| WO | 2011/144411 | A1 | 11/2011 | F02M 55/00 |

OTHER PUBLICATIONS

Chinese Office Action, Application No. 201410326954.1, 12 pages, dated Apr. 27, 2017.

* cited by examiner

FUEL INJECTION ASSEMBLY FOR A COMBUSTION ENGINE

CROSS-REFERENCE TO RELATED APPLICATIONS

This application claims priority to EP Patent Application No. 13175850 filed Jul. 10, 2013. The contents of which are incorporated herein by reference in their entirety.

TECHNICAL FIELD

The invention relates to an fuel injection assembly for a combustion engine.

BACKGROUND

Injectors are in widespread use, in particular for internal combustion engines, where they may be arranged in order to dose fluid into an intake manifold of an internal combustion engine or directly into a combustion chamber of a cylinder of the internal combustion engine.

To reach a good engine performance, the orientation of such a high pressure fuel injector in reference to the combustion chamber should be guaranteed.

WO 2011/144411 A1 discloses a fuel cup including a central longitudinal axis and being fixable to an injector via a holder comprises a fuel cup body and a fixing element. This fuel cup is characterized in that said fixing element is a stamped tab affixed to said fuel cup body, and in that said stamped tab is designed to be engaged to said holder.

SUMMARY

One embodiment provides a fuel injection assembly for a combustion engine having a central longitudinal axis and comprising: an injector body axially extending from a fuel inlet end to a fuel outlet end, an injector cup, which radially encloses the fuel inlet end of the injector body, a spring clip, which mechanically couples the injector cup with the injector body, wherein the spring clip comprises: a ground plate with a main extension plane extending perpendicular to the longitudinal axis, a recess extending inwards from one lateral end of the ground plate from an opening to a bottom part, the bottom part, in top view on the main extension plane, having a contour shaped as a circle segment which extends over an angle between 270° to 180°, at least one spring element fixedly coupled with the ground plate, wherein the spring element of the spring clip has a contact region with the injector cup and the ground plate has a contact region with the injector body, so that the spring element is operable to exert a spring force on the injector body, wherein the spring clip is snap-fixed with the injector body by means of the bottom part of the recess, wherein the injector cup has a cutout and the ground plate of the spring clip extends into the cutout of the injector cup.

In a further embodiment, the fuel injection assembly is configured to be fixed to a cylinder head of the combustion engine, and wherein the ground plate is axially displaceable in the cutout and positioned in the cutout in such fashion that, when the fuel injection assembly is fixed to the cylinder head, the ground plate is at a distance from an edge of the cutout adjacent to the fuel outlet end.

In a further embodiment, the cutout is about as broad in a direction perpendicular to the longitudinal axis as a maximal width of the ground plate of the spring clip in said direction.

In a further embodiment, the injector cup has a trough portion and a base portion subsequent to the trough portion in axial direction towards the fluid outlet end, wherein the trough portion has a recess in which the fuel inlet end of the injector body is received, the base portion laterally surrounds the recess and comprises the cutout.

In a further embodiment, the base portion has a first plate section and a second plate section, the first plate section having a main plane of extension extending perpendicular to the longitudinal axis and the second plate section having a main plane of extension extending parallel to the longitudinal axis, wherein the cutout is comprised by the second plate section and perforates the second plate section in radial direction.

In a further embodiment, the cutout has a rectangular basic shape.

In a further embodiment, the injector body comprises a step, which is arranged in a part of the recess of the ground plate to prevent a rotary movement between the injector body and the spring clip.

In a further embodiment, the width of the step has about the same lateral extent as the opening of the recess.

In a further embodiment, the injector body has a radial protrusion positioned between the ground plate of the spring clip and the fuel inlet end of the injector body, wherein the protrusion has a radius which is larger than the radius of the contour of the bottom part of the recess of the ground plate.

In a further embodiment, the at least one spring element is a spring arm formed integrally with the ground plate by bending.

In a further embodiment, the injector body has a generally cylindrical receiving part and the spring clip is snap-fixed with the cylindrical receiving part of the injector body.

In a further embodiment, the receiving part is a metal tube, the injector body comprises a plastic housing which extends circumferentially around the metal tube and the contact region of the ground plate abuts the plastic housing.

In a further embodiment, the cutout has a chamfered edge, which is facing towards the injector body and which is positioned adjacent to the side of the ground plate comprising the contact region with the injector body.

In a further embodiment, the ground plate has a chamfered edge, which is inclined in such fashion that, in the course from the side of the ground plate comprising the contact region of the ground plate towards the side adjacent to the contact region of the spring clip, the distance of the chamfered edge of the ground plate from the longitudinal axis increases and which is positioned adjacent to the cutout of the injector cup.

In a further embodiment, the spring clip is a metal spring clip.

BRIEF DESCRIPTION OF THE DRAWINGS

Example embodiments of the invention are explained below with reference to the drawings, in which.

DETAILED DESCRIPTION

Figure 1:
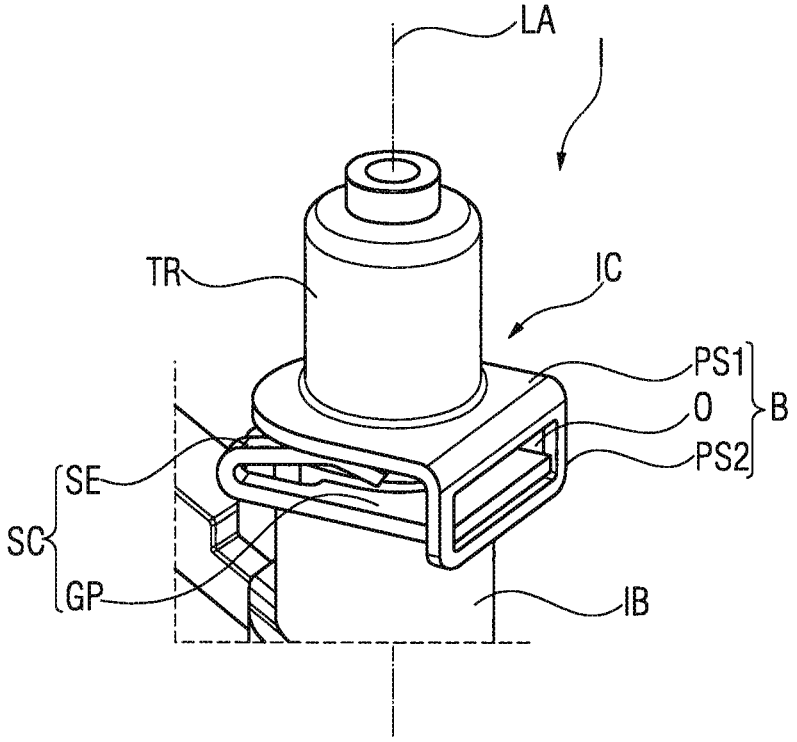
FIG. 1 fuel injection assembly with an injector body, a spring clip and an injector cup according to a first embodiment, FIG. 2 the injector body of the fuel injection assembly, FIG. 3 the spring clip of the fuel injection assembly, FIG. 4 the injector cup of the fuel injection assembly, FIG. 5 a side view of the fuel injection assembly, FIG. 6 a front view of the fuel injection assembly, FIG. 7 the fuel injection assembly in a longitudinal section view along the plane 8-8, FIG. 8 the fuel injection assembly in a cross section view along the plane 7-7.

Embodiments of the present invention provide a fuel injection assembly for a combustion engine which is particularly cost efficient and reliable.

A fuel injection assembly for a combustion engine is specified. The fuel injection assembly has a central longitudinal axis. It comprises an injector body and an injector cup.

The injector body in particular extends along the longitudinal axis from a fuel inlet end to a fuel outlet end. In one embodiment, the injector body comprises a metal tube and a plastic housing which extends partially or completely around the metal tube. The metal tube may contribute to hydraulically coupling the fuel inlet end with the fuel outlet end of the injector body. The plastic housing may house an external electrical connector for connecting the injector body to a power supply and/or a coil of an electromagnetic actuator unit. The electromagnetic actuator unit may be provided for opening and closing an injection nozzle at the fuel outlet end of the injector body.

The injector cup radially encloses an axial end of the injector body. The axial end is in particular a fuel inlet end of the injector body. Thus, in other words, the fuel inlet end of the injector body is received in the injector cup so that the injector cup extends circumferentially around the injector body.

The fuel injection assembly further comprises a spring clip. The spring clip mechanically couples the injector cup with the injector body.

The spring clip comprises a ground plate with a normal parallel to the longitudinal axis. In other words, the ground plate has a main extension plane which extends perpendicular to the longitudinal axis. The main extension plane of an element, e.g. the ground plate, in the present disclosure is in particular understood to be the plane which is defined by those two orthogonal directions in which the respective element has its largest and second largest dimension and which, in particular, comprises the geometrical center of gravity of the respective element.

The spring clip further comprises a recess extending inwards from one end of the ground plate and comprising a partly circular cross-section in an angle between 270° to 180° on the end of the recess, which is facing away from the end of the ground plate, where it extends. In other words, the spring clip—in particular the ground plate of the spring clip—has a recess. The recess extends inwards into the ground plate from one lateral end of the ground plate from an opening of the recess to a bottom part of the recess. In particular, the recess—in top view of the main extension plane of the ground plate—extends laterally from an opening at one edge of the ground plate towards an opposite edge of the ground plate. The recess extends preferably completely through the ground plate in axial direction. The longitudinal axis preferably extends through the recess.

The bottom part, in top view on the main extension plane of the ground plate, has a contour which is shaped as a circle segment. The circle segment preferably extends over an angle between 180° and 270°. The end points of the circle segment preferably face towards the opening of the recess.

The spring clip further comprises at least one spring element fixedly coupled with the ground plate. The spring element of the spring clip has a contact region with the injector cup and the ground plate has a contact region with the injector body, so that the spring element is operable to exert a spring force on the injector cup. The contact region of the ground plate may, for example, about the plastic housing of the injector body.

In particular, the spring element is operable to bias the injector body in axial direction away from the injector cup when the spring element is pre-loaded by the injector cup. Pre-loading the spring element may be effected by the injector cup in particular by mechanical interaction via the contact region of the spring clip with the injector cup.

The spring clip is snap-fixed with the injector body by means of the circular part of the recess. The injector cup has a cutout and the ground plate of the spring clip extends into the cutout of the injector cup. The cutout preferably has a rectangular basic shape.

With advantage, the fuel injection assembly has a particularly small number of parts. In this way, it can easily be manufactured and is particularly cost-effective.

Further, movement between injector body and injector cup may be advantageously restricted in the fuel assembly. Because the cutout of the injector cup is about as broad as a maximum width of the ground plate of the spring clip, the spring clip is insertable into the cutout of the injector cup. Thus an easy assembly is achieved. Because the ground plate extends into the cutout of the injector cup a rotary movement between injector cup and spring clip is prevented, especially if the part of the ground plate, which extends into the cutout is about as broad as the cutout.

By the clamping force of the snap-fixed coupling of the spring clip and the injector body a rotary movement between the injector body and the spring clip is prevented, thus also a rotary movement between the injector cup and the injector body is prevented. The value of the clamping force depends on the angle of the circular part of the recess. The angle is, for example, advantageously between 260° to 240°.

The fuel injection assembly is preferably designed for being fixed to a cylinder head of the combustion engine. In an expedient embodiment, the ground plate is axially displaceable in the cutout of the injector cup. The cutout may be operable to limit axial displacement of the ground plate with respect to the injector cup. The ground plate is preferably positioned in the cutout in such fashion that, when the fuel injection assembly is fixed to the cylinder head, the ground plate is at a distance from an edge of the cutout adjacent to the fuel outlet end.

With advantage, the contact region of the ground plate is in contact with the injector body when the fuel injection assembly is fixed to the cylinder head and the injector cup is operable to press the injector body against the cylinder head by means of the spring clip. Due to the position and axial movability of the ground plate in the cutout, the spring force on the injector body is basically independent of the coupling of the spring clip with the injector cup by means of the cutout.

In one embodiment, the cutout is about as broad in a direction perpendicular to the longitudinal axis as a maximal width of the ground plate of the spring clip in said direction. In another embodiment, the cutout and a portion of the ground plate which is arranged within the cutout have substantially the same width.

In the present context, "about as broad" and "substantially the same width" are in particular understood to mean that the widths of the cutout and of the ground plate are adapted to each other to lock the spring clip and the injector cup with respect to relative rotational movement around the longitudinal axis. The width of the cutout preferably exceeds the width of the ground plate or of said portion of the ground plate by 10% or less, preferably by 5% or less, for example by 2% or less.

In one embodiment, the injector cup has a trough portion and a base portion. The trough portion has a recess in which the fuel inlet end of the injector body is received. The base portion is positioned subsequent to the trough portion in axial direction towards the fluid outlet end of the injector body. The base portion laterally surrounds the recess and comprises the cutout. Preferably, the base portion has a first plate section and a second plate section, the first plate section having a main plane of extension extending perpendicular to the longitudinal axis and the second plate section having a main plane of extension extending parallel to the longitudinal axis, wherein the cutout is comprised by the second plate section and perforates the second plate section in radial direction. The first plate section may be coupled to the trough portion. The first plate section may extend circumferentially around the injector body.

With advantage, the injector cup according to this embodiment can be manufactured particularly easily and cost efficient, for example by deep-drawing, bending and punching. In addition, it may be particularly simple to position the spring clip.

According to one embodiment the injector body comprises a step, which is arranged in a part of the recess of the ground plate. The step is arranged and designed to prevent a rotary movement between the injector body and the spring clip. In other words, the step is in engagement with the recess for rotationally blocking relative rotational movement of the injector body and the spring clip with respect to each other. The step is preferably comprised by a lug of the injector body, in particular of the plastic housing.

By means of the step, a rotary movement between the spring clip and the injector body can be prevented and thus also a rotary movement between the injector cup and the injector body can be prevented.

According to a further embodiment the step is about as broad as the part of the recess in which the step is arranged. In other words, the step has basically the same lateral extent as the opening of the recess. Hereby even very little rotary movements can be prevented. In the present context, "about as broad" and "basically the same lateral extent" is in particular understood to mean that the widths of the step and of the opening of the recess are adapted to each other to lock the spring clip and the injector body with respect to relative rotational movement around the longitudinal axis. The width of the opening of the recess preferably exceeds the width of the step by 10% or less, preferably by 5% or less, for example by 2% or less.

According to a further embodiment, the injector body has a protrusion in radial direction between the ground plate of the spring clip and the axial end of the injector body, which is enclosed by the injector cup. In other words, the protrusion is a radial protrusion of the injector body, which is positioned, in axial direction, between the fuel inlet end of the injector and the ground plate of the spring clip. The radial protrusion extends partially or completely circumferentially around the injector body. The protrusion has a radius which is larger than the radius of the circle segment shaped contour of the bottom part of the recess of the ground plate.

Hereby an axial movement of the ground plate—and thus of the spring clip—is restricted in one axial direction by the protrusion, specifically in axial direction towards the fuel inlet end of the injector body. The axial movement in the other direction is restricted by the contact plane of the ground plate with the injector body. Because the spring clip extends into the cutout of the injector cup, also an axial movement of the injector cup is restricted by the axial height of the cutout. With advantage, the protrusion and the cutout cooperate to retain the injector body in the injector cup during transportation and installation of the fuel injection assembly. By means of the spring clip mechanically interacting with the injector body via the protrusion and with the injector cup via the cutout, there is a particularly small risk that the fuel injection assembly is inadvertently disassembled during transportation or installation.

According to a further embodiment, the at least one spring element is a spring arm formed integrally with the ground plate, for example by bending. In other words, the ground plate and the spring element or the spring elements are preferably in one piece. In one development, the spring clip is a one-piece part having a portion which represents the ground plate and a further portion which represents the spring element(s). Hereby the spring element can be manufactured and coupled to the injector cup and injector body easily.

According to a further embodiment, the injector body has a cylindrical receiving part and the spring clip is snap-fixed with the cylindrical receiving part of the injector body. The cylindrical receiving part may be arranged adjacent to the fuel inlet end of the injector body. In another embodiment, the spring clip is snap-fixed with the metal tube of the injector body. In one development of this embodiment, the metal tube may comprises the receiving part which is in particular cylinder-shaped.

Expediently, the radius of the cylindrical receiving part may be about the same as the radius of the circle-segment shaped contour of the bottom part of the recess of the ground plate. In particular, the length of the secant between the two ends of the circle-segment shaped contour is smaller than the diameter of the receiving part and the diameter of the circle-segment shaped contour is at least as large as the diameter of the receiving part. The diameter of the circle-segment shaped contour may exceed the diameter of the receiving part by 10% or less, preferably by 5% or less, for example by 2% or less.

With advantage, the spring clip may be snap-fixed with the metal tube instead of the plastic housing. In this way, a simple construction of the fuel injection assembly is achievable. The coupling of the spring clip with the injector body may be particularly reliable. In addition, there may be particularly little requirements with respect to the mechanical stability of the plastic housing.

Because the radius of the cylindrical receiving part is about the same as the radius of the circular part of the recess of the ground plate a high clamping force of the coupling of the spring clip and the injector body can be achieved.

According to a further embodiment the injector cup comprises a chamfer on the edge of the cutout, which is directed to the injector body and which is directed to the contact plane of the ground plate with the injector body. In other words, the cutout has a chamfered edge which is facing towards the injector body and which is positioned adjacent to the side of the ground plate comprising the contact region with the injector body. The surface of the chamfered edge is, thus, inclined such that, in radially outward course, it approaches the fuel inlet end of the injector body.

By this chamfer the spring element can be easily inserted into the cutout of the injector cup and can easily be disassembled again.

According to a further embodiment, the edge of the side of the ground plate, which has the contact plane with the injector body and which is directed to the cutout of the injector cup, comprises a chamfer. In other words, the ground plate has a chamfered edge, which is positioned adjacent to the cutout of the injector cup and which is inclined in such fashion that, in the course from the side of the ground plate comprising the contact region of the ground plate towards the side adjacent to the contact region of the spring clip, the distance of the chamfered edge of the ground plate from the longitudinal axis increases.

By this chamfer the spring element can be easily inserted into the injector cup and can easily be de-assembled again. For an easy assembly and disassembly of the fuel injection assembly, it is particularly advantageous if both the cutout and the ground plate have the chamfered edges.

According to a further embodiment the spring clip is a metal spring clip.

FIG. 1 shows an fuel injection assembly I that is particularly suitable for dosing fuel to an internal combustion engine. The fuel injection assembly I has a central longitudinal axis LA. It comprises an injector body IB which extends along the longitudinal axis LA from a fuel inlet end to a fuel outlet end. The fuel injection assembly I further comprises an injector cup IC, which radially encloses the fuel inlet end of the injector body IB. The fuel injection assembly I further comprises a spring clip SC, which mechanically couples the injector cup IC with the injector body IB.

Figure 2:
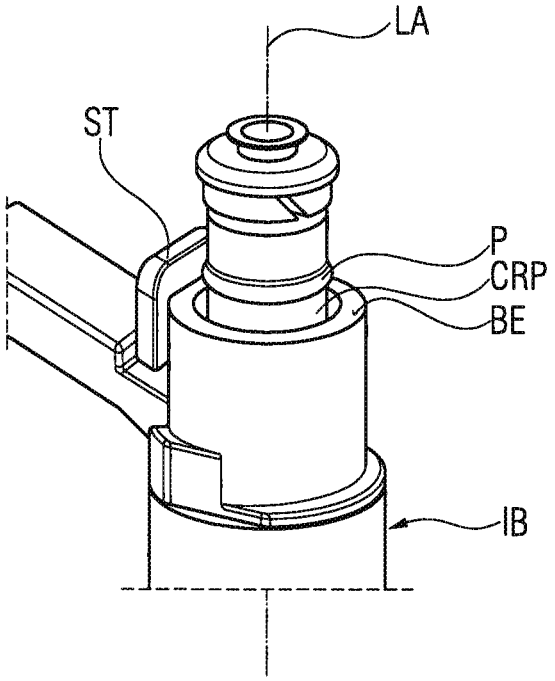

The injector body IB is shown in FIG. 2. The injector body IB comprises a metal tube and a plastic housing extending circumferentially around the metal tube.

The plastic housing has a lug adjacent to an external electrical connector. The lug comprises a step ST. The step ST is, for example, made of plastic. The plastic housing further has a bearing BE.

The metal tube comprises a cylindrical receiving part CRP and a protrusion P. The cylindrical receiving part CRP is arranged axially between the protrusion P and the bearing BE.

The function of the step ST, the bearing BE, the cylindrical receiving part CRP and the protrusion P will be described later.

Figure 3:
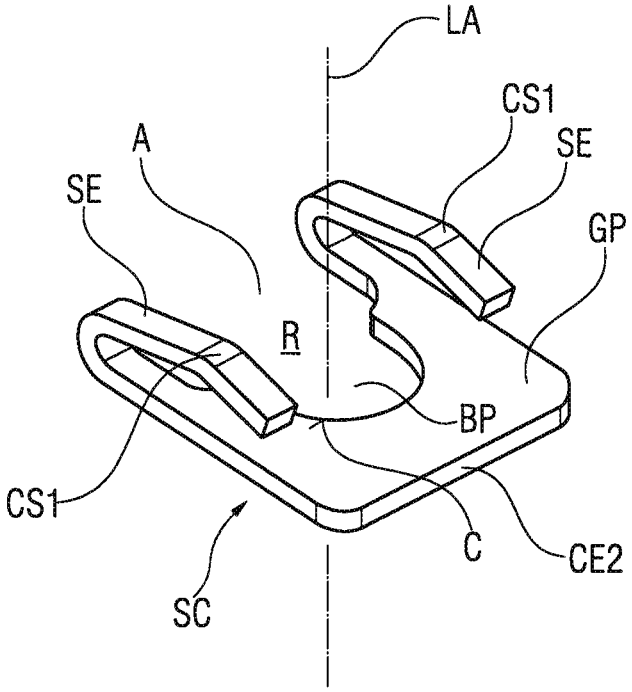

FIG. 3 shows the spring clip SC of the fuel injection assembly I, which is a metal spring clip SC in the present embodiment. The spring clip SC is a one-piece part which comprises a portion representing a ground plate GP and a portion representing two spring elements SP.

The ground plate GP has a normal parallel to the longitudinal axis LA, i.e. it has a main plane of extension which is perpendicular to the longitudinal axis LA.

Figure 8:
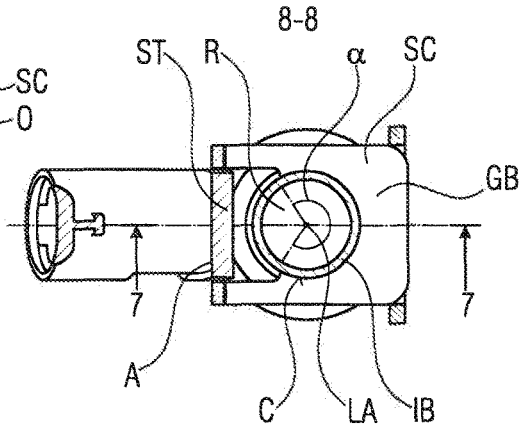

A recess R extends laterally inwards into the ground plate GP from an opening A at one lateral edge of the ground plate GP to a bottom part BP. In top view on the main extension plane of the ground plate GP, the bottom part BP has a contour C which is shaped as a circle segment, the circle segment extending over an angle $\alpha$ between 270° to 180° (FIG. 8).

The two spring elements SE which are fixedly coupled with the ground plate GP—by means of being integrally formed with the ground plate GP. In the present embodiment, the spring elements SP are spring arms formed integrally with the ground plate GP by bending.

The spring elements SE completely overlap with the ground plate GP in top view along the longitudinal axis LA in the present embodiment. In this way, the spring element consumes particularly little space. Spring elements SE which completely overlap with the ground plate GP in top view along the longitudinal axis LA are also suitable for other embodiments of the fuel injection assembly I.

Figure 4:
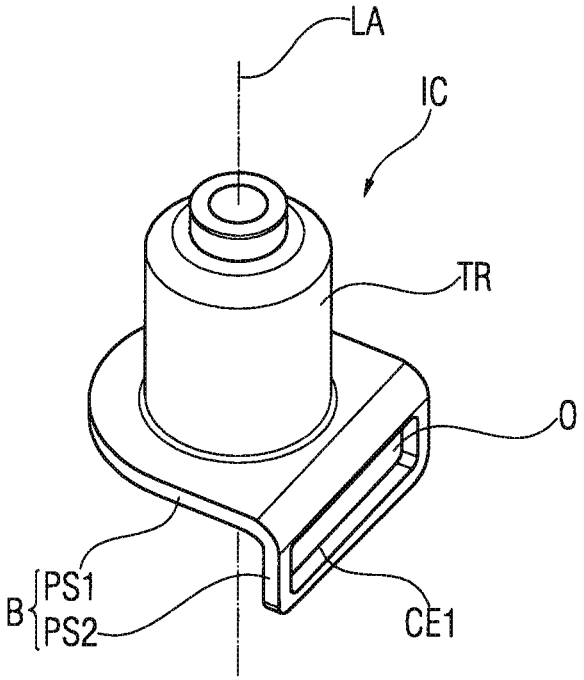

FIG. 4 shows the injector cup IC of the fuel injection assembly I. The injector cup has a trough portion TR for receiving the fuel inlet end of the injector body IB. Further, the injector cup IC has a base portion B which is arranged subsequent to the trough portion TR in axial direction LA towards the fuel outlet end of the injector body IB.

The base portion B comprises a first plate section PS1 which has a main plane of extension which is perpendicular to the longitudinal axis. The first plate section PS1 extends circumferentially around the trough portion TR as a collar. In addition, the base portion B comprises a second plate section PS2 which has a main plane of extension which is parallel to the longitudinal axis LA.

The injector cup IC has a cutout O which is comprised by the second plate section PS2 and perforates the latter in a radial direction. The cutout O is about as broad in a direction perpendicular to the longitudinal axis LA as a maximal width of the ground plate GP of the spring clip SC in said direction.

The injector I is assembled as follows:

First, the injector cup IC is positioned on the fuel inlet end of the injector body IB. Then the spring clip SC is inserted in the cutout O of the injector cup IC and is snap-fixed with the injector body IB by means of the circular part of the recess. The spring clip SC is, for example, snap-fixed with the cylindrical receiving part CRP of the injector body IB.

More specifically, the spring clip SC may be inserted into the cutout O from its side comprising the opening A of the recess and may be partially moved through the cutout O in lateral direction, so that the opening A moves laterally through the cutout O to the side of the cylindrical receiving part CRP opposite the second plate section PS2.

When the bottom part BP of the recess R of the spring clip SC moves along the cylindrical receiving part, the spring clip is elastically deformed in lateral direction so that it can be moved further although the aperture of its circle segment shaped contour C is smaller than the diameter of the cylindrical receiving portion CRP. After the aperture of the contour C has passed the largest lateral extent of the cylindrical receiving portion CRP, the spring clip will snap back to its un-deformed shape so that the snap-fix connection is established. Further lateral movement of the spring clip is then prevented by the form fit between the bottom part BP of the recess R and the cylindrical receiving portion CRP.

Figure 6:
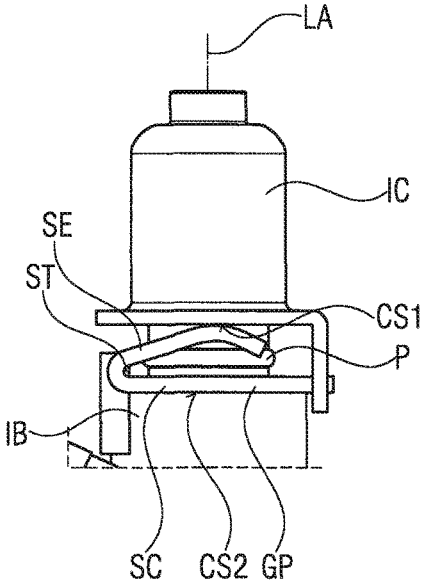
Figure 7:
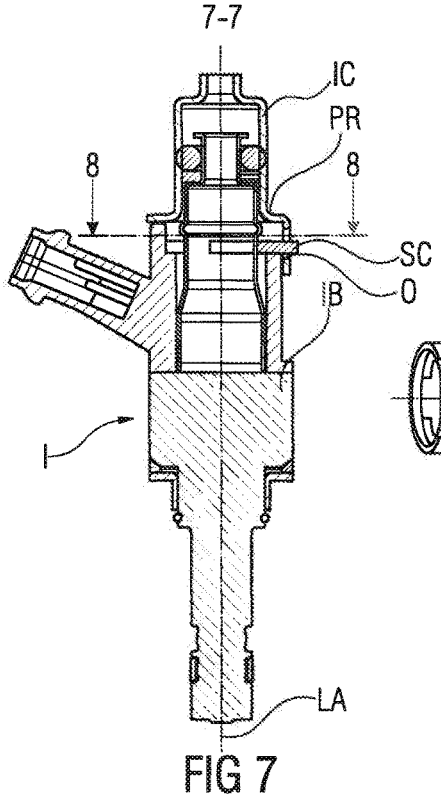

In this lateral position, the ground plate GP of the spring clip SC is still in engagement with the cutout O of the injector cup IC (see FIGS. 6, 7, and 8).

The spring element SE has a contact region CS1 with the injector cup IC (see FIG. 6). The ground plate GP has a contact plane CS2 with the bearing BE of the injector body IB (see FIG. 6). Thus, a spring force is exerted by the spring clip SC on the injector body IB when the injector cup IC is fixed with the cylinder head of the internal combustion engine in such fashion that the spring is pre-loaded.

Figure 5:
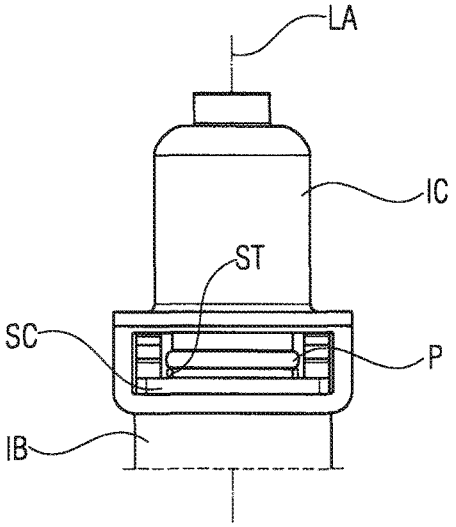

The cutout O is advantageously about as broad in a lateral direction as a maximal width of the part of the ground plate GP which extends into the cutout O (see FIG. 5, 8). Hereby very little rotary movement between the injector cup IC and the spring clip SC is possible.

The step ST of the injector body IB is in a part of the recess of the ground plate GP. For example, the step ST is about as broad as opening A of the recess R which is in engagement which the step ST (see FIG. 8). Hereby very little rotary movement between the injector body IB and the spring clip SC is possible and thus very little rotary movement between the injector body IB and the injector cup IC is possible.

The protrusion P has a radius which is larger than the radius of the contour C of the bottom part BP of the recess R of the ground plate GP. Therefore an axial displacement of the spring clip SC with respect to the injector body IB is restricted in one direction by the protrusion P. The axial movement in the other direction is restricted by the bearing BE of the injector body IB. Because the spring clip SC extends into the cutout O of the injector cup IC, also an axial movement of the injector cup IC is limited by the axial height of the opening O.

Figure 9:
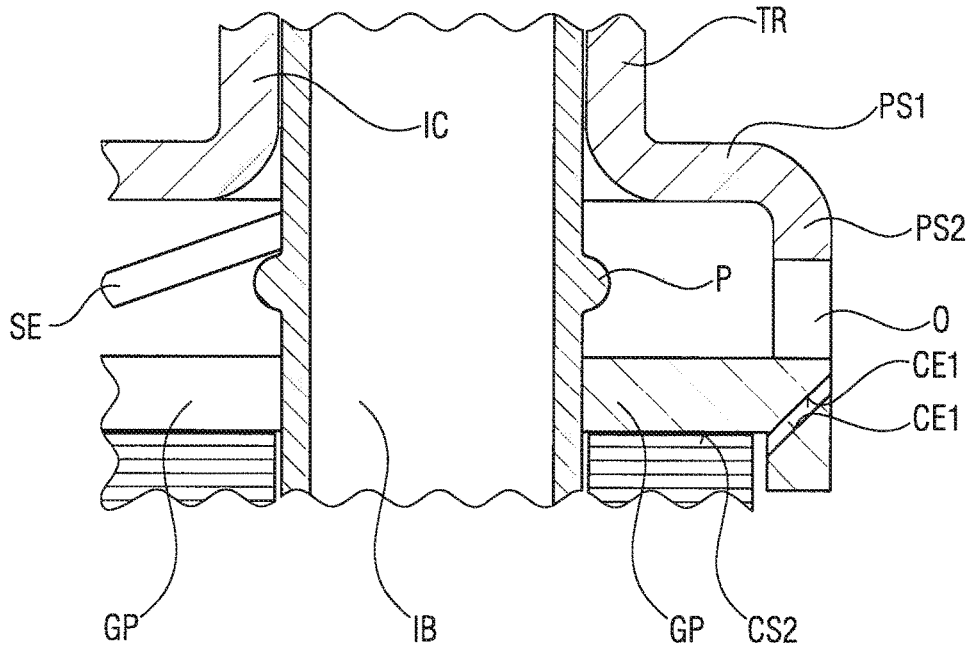
FIG. 9 shows a longitudinal section view of a portion of a fuel injection assembly according to a second embodiment.

FIG. 9 shows a portion of a fuel injection assembly I according to a second exemplary embodiment in a schematic longitudinal section view. The fuel injection assembly I of the second embodiment corresponds in general with the fuel injection assembly I of the first embodiment.

However, the edge CE1 (cf. FIG. 4) of the cutout O, which is adjacent to the side of the ground plate GP which comprises the contact region CS2 comprises a chamfer. The chamfered edge CE1 faces towards the injector body IP, i.e. the surface of the chamfered edge CE1 is inclined such that, in radially outward course, it approaches the fuel inlet end of the injector body IB.

In addition, the edge CE2 (cf. FIG. 3) of the side of the ground plate GP, which is adjacent to the cutout O also comprises a chamfer. The chamfered edge CE2 of the ground plate GP is inclined in such fashion that, in the course from the side of the ground plate GP comprising the contact region CS2 to the side adjacent to the contact region CS1 of the spring clip SC, the distance of the chamfered edge CE2 from the longitudinal axis LA increases.

What is claimed is:

1. A fuel injection assembly for a combustion engine having a central longitudinal axis and comprising:

an injector body axially extending from a fuel inlet end to a fuel outlet end, an injector cup that radially encloses the fuel inlet end of the injector body, a spring clip that mechanically couples the injector cup with the injector body, wherein the spring clip comprises:

a ground plate having a main extension plane extending perpendicular to the longitudinal axis, an opening through one side of the ground plate extending inwards to a bottom part having a contour shaped as a circle segment extending perpendicular to the longitudinal axis over an angle between 270° and 180°, and at least one spring element fixedly coupled with the ground plate, the at least one spring element extending away from the ground plate along the central longitudinal axis toward the injector cup, wherein the spring element of the spring clip has a contact region with the injector cup at an axial distance away from the ground plate and the ground plate has a contact region with the injector body, such that the spring element is operable to exert a spring force on the injector body parallel to the central longitudinal axis urging the injector body away from the injector cup, wherein the spring clip is snap-fixed with the injector body when the injector body enters through the opening and reaches the bottom part of the opening, and wherein the injector cup includes a plate section with a main plane of extension parallel to the central longitudinal axis and a cutout and the ground plate is the only part of the spring clip extending into the cutout of the injector cup.

2. The fuel injection assembly of claim 1, wherein the fuel injection assembly is configured for attachment to a cylinder head of the combustion engine, and wherein the ground plate is axially displaceable in the cutout and positioned in the cutout such that, when the fuel injection assembly is fixed to the cylinder head, the ground plate is at a distance from an edge of the cutout adjacent to the fuel outlet end.

3. The fuel injection assembly of claim 1, wherein a width of the cutout is in a direction perpendicular to the longitudinal axis is approximately the same as a maximal width of the ground plate of the spring clip in said direction.

4. The fuel injection assembly of claim 1, wherein the injector cup has a trough portion and a base portion beyond to the trough portion in an axial direction towards the fluid outlet end of the injector body, wherein the trough portion has a recess that receives the fuel inlet end of the injector body, wherein the base portion laterally surrounds the recess and comprises the cutout.

5. The fuel injection assembly of claim 1, wherein the cutout has a rectangular shape.

6. The fuel injection assembly of claim 1, wherein the injector body comprises a step arranged in a part of the opening of the ground plate to prevent a rotary movement between the injector body and the spring clip.

7. The fuel injection assembly of claim 6, wherein a width of the step has substantially the same lateral extent as the opening of the recess.

8. The fuel injection assembly of claim 1, wherein the injector body has a radial protrusion positioned between the ground plate of the spring clip and the fuel inlet end of the injector body, wherein the protrusion has a radius that is larger than a radius of the contour of the bottom part of the opening of the ground plate.

9. The fuel injection assembly of claim 1, wherein the at least one spring element comprises a spring arm formed integrally with the ground plate by bending.

10. The fuel injection assembly of claim 1, wherein the injector body has a cylindrical receiving part and the spring clip is snap-fixed with the cylindrical receiving part of the injector body.

11. The fuel injection assembly of claim 10, wherein the receiving part is a metal tube, and the injector body comprises a plastic housing that extends circumferentially around the metal tube and the contact region of the ground plate abuts the plastic housing.

12. The fuel injection assembly of claim 1, wherein the cutout has a chamfered edge facing towards the injector body and which is positioned adjacent to a side of the ground plate comprising the contact region with the injector body.

13. The fuel injection assembly of claim 1, wherein the ground plate has a chamfered edge inclined such that, in a course from the side of the ground plate comprising the contact region of the ground plate towards the side adjacent to the contact region of the spring clip, a distance of the chamfered edge of the ground plate from the longitudinal axis increases and which is positioned adjacent to the cutout of the injector cup.

14. The fuel injection assembly of claim 1, wherein the spring clip comprises a metal spring clip.

15. An internal combustion engine, comprising:

a fuel injection assembly having a central longitudinal axis and comprising:

an injector body axially extending from a fuel inlet end to a fuel outlet end, an injector cup that radially encloses the fuel inlet end of the injector body, a spring clip that mechanically couples the injector cup with the injector body, wherein the spring clip comprises:

a ground plate having a main extension plane extending perpendicular to the longitudinal axis, an opening through one side of the ground plate extending inwards to a bottom part having a contour shaped as a circle segment extending perpendicular to the longitudinal axis over an angle between 270° and 180°, and at least one spring element fixedly coupled with the ground plate, the at least one spring element extending away from the ground plate along the central longitudinal axis toward the injector cup, wherein the spring element of the spring clip has a contact region with the injector cup at an axial distance away from the ground plate and the ground plate has a contact region with the injector body, such that the spring element is operable to exert a spring force on the injector body parallel to the central longitudinal axis urging the injector body away from the injector cup, wherein the spring clip is snap-fixed with the injector body when the injector body enters through the opening and reaches the bottom part of the opening, and wherein the injector cup includes a plate section with a main plane of extension parallel to the central longitudinal axis and a cutout and the ground plate is the only portion of the spring clip extending into the cutout of the injector cup.

* * * * *